United States Patent [19]

Matsuura et al.

[11] Patent Number: 4,858,577

[45] Date of Patent: Aug. 22, 1989

[54] ROTARY VALVE DEVICE FOR INTERNAL COMBUSTION ENGINES

[75] Inventors: Masaaki Matsuura; Mitsuru Ishikawa, both of Tokyo; Masaharu Nakamori; Masahiro Kuroki, both of Saitama, all of Japan

[73] Assignee: Honda Giken Kogyo Kabushiki Kaisha, Tokyo, Japan

[21] Appl. No.: 207,030

[22] Filed: Jun. 14, 1988

Related U.S. Application Data

[63] Continuation of Ser. No. 913,524, Sep. 30, 1986, abandoned.

[30] Foreign Application Priority Data

Sep. 30, 1985 [JP] Japan ..... 60-216388
Sep. 30, 1985 [JP] Japan ..... 60-216389
Sep. 30, 1985 [JP] Japan ..... 60-216390

[51] Int. Cl.[4] ..... F01L 7/10

[52] U.S. Cl. ..... 123/190 A; 123/80 BA; 123/190 E

[58] Field of Search ..... 123/81 R, 81 B, 80 DA, 123/190 A, 190 R, 80 R, 80 BA, 190 E, 190 BD, 190.8, 80 D, 81 D; 137/625.41

[56] References Cited

U.S. PATENT DOCUMENTS 1,135,719 4/1915 Ritter ..... 123/190 A
1,414,692 5/1922 Dickerson ..... 123/190 A
2,370,283 2/1945 Baker ..... 123/190 BD
2,857,902 10/1958 Van Worst ..... 123/190 BD
2,874,686 2/1959 Carey ..... 123/81
3,256,910 6/1966 Cupp ..... 137/625.41
3,730,161 5/1973 Deanne ..... 123/80 R

FOREIGN PATENT DOCUMENTS 2350075 10/1976 Fed. Rep. of Germany .
2928450 3/1980 Fed. Rep. of Germany .
2028920A 3/1980 United Kingdom .

*Primary Examiner*—Willis R. Wolfe
*Assistant Examiner*—M. Macy
*Attorney, Agent, or Firm*—Lyon & Lyon

[57] ABSTRACT

A rotary valve system for an internal combustion engine having ball-type valves with through bores. The valves are driven by rocking cam mechanisms within passageways for controlling communication through intake and exhaust passages. Valve seats are arranged to either side of the valves such that sealing thereof may occur. In one embodiment, side cut portions are employed to allow either intake or exhaust gases to flow around the valve body as well as through the through bore when the valve is in the opening or closing orientation. In another embodiment, a through bore of square cross section is provided to increase flow during opening and closing thereof. In a third embodiment, a bias mechanism is employed to provide torque on the valves and drive mechanism to eliminate clearances such that impact between components will be reduced or eliminated.

19 Claims, 7 Drawing Sheets

FIG. 8.
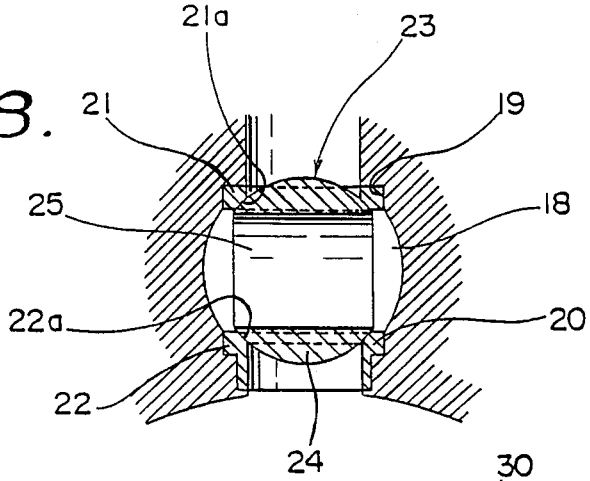
FIG. 9.
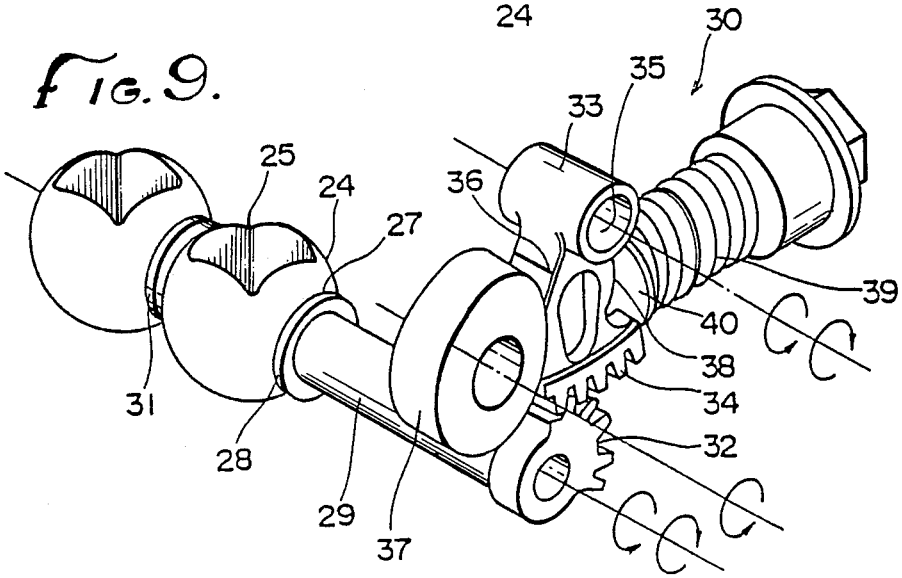
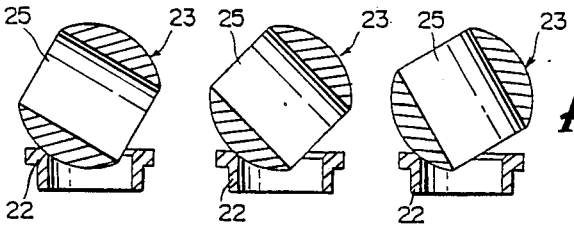
FIG. 10.
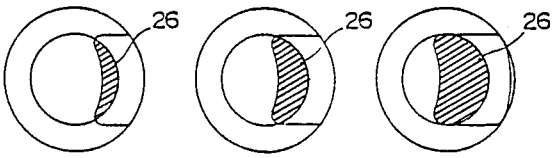
FIG. 11.

FIG. 15.
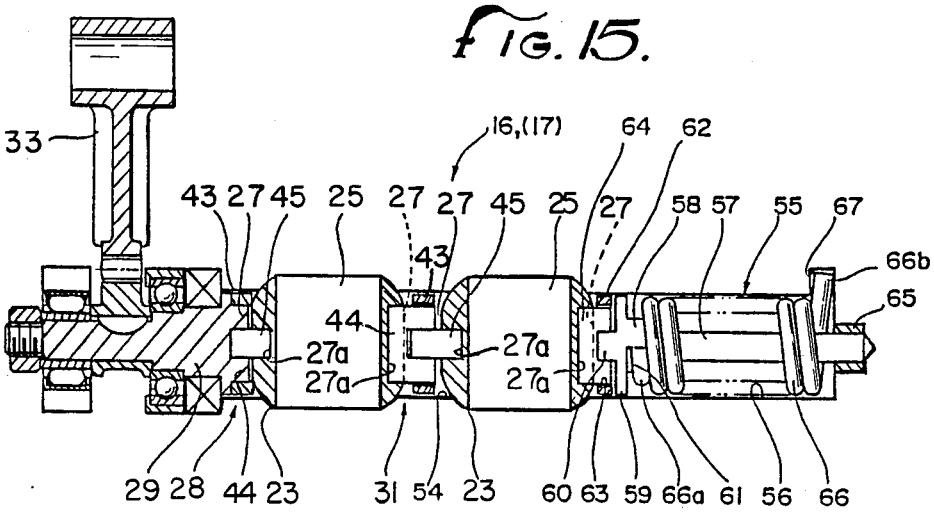
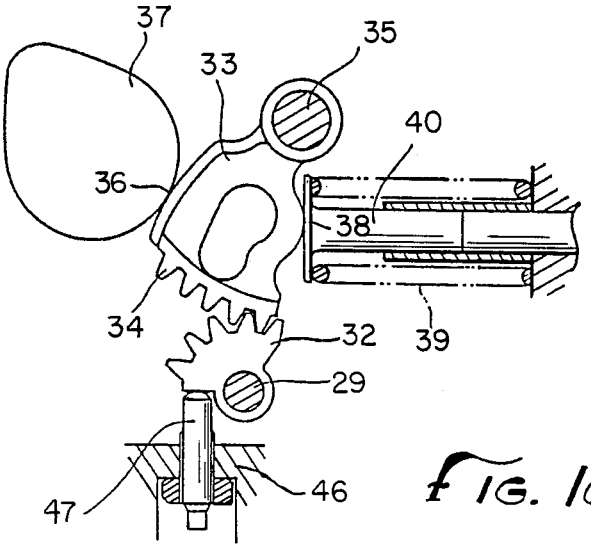
FIG. 16.
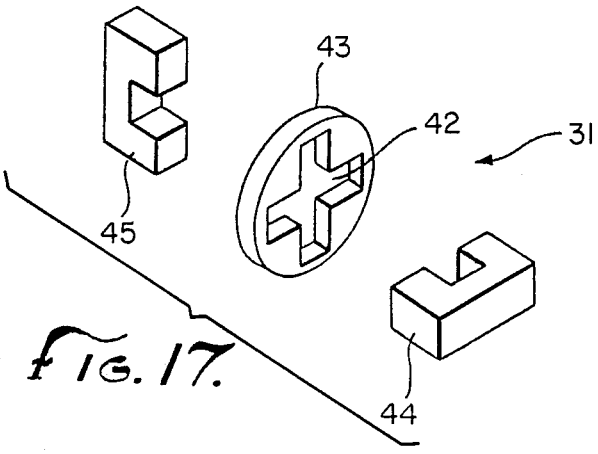
FIG. 17.

ROTARY VALVE DEVICE FOR INTERNAL COMBUSTION ENGINES

This application is a continuation of application Ser. No. 913,524, filed Sept. 30, 1986, now abandoned.

BACKGROUND OF THE INVENTION

The field of the present invention is valve systems for internal combustion engines and, more specifically rotary valve systems.

Poppet valves have been almost universally employed on four-stroke internal combustion engines, principally because of good sealing properties. However, with modern high-speed engines, poppet valves exhibit certain disadvantages as well. Exhaust poppet valves constantly facing the combustion chamber can become overheated and promote preignition. The requirement that such valves have both valve shafts and valve heads always located in the opening and passage of the porting affects intake and exhaust efficiencies. Furthermore, disadvantageous flow characteristics result from the circuitous flow path required by such valve configurations. Such valves also develop substantial impact noise upon closing.

To solve the foregoing difficulties with poppet valves, recurring efforts have been undertaken toward construction rotary or sleeve valves. Such efforts have been directed to ball valves, cylinder valves, conical valves, disc valves and the like. However, such valves which are sufficiently compact for internal combustion engines tend to have inefficiencies in the relative portion of time during which such valves are opening and closing as distinguished from remaining open.

One such prior valve is illustrated in FIGS. 5 and 6. A ball-type valve body 1 includes a through bore 2 with an outer spherical sliding surface 3 around the bore. The rotary valve A thus constituted is rotatably held in the seat members 7 and 8 and the spherical sliding surface 3 contacts the upper and lower seat members 7 and 8 in the receiving area of the intake or exhaust passage 5.

In the device illustrated in FIGS. 5 and 6, the rotary valve A is rotated intermittently by a driving means. When the valve rotates, air/fuel mixture in the case of an intake passage may flow into the combustion chamber 4 via the through bore 2. However, the air/fuel mixture must flow entirely through the through bore 2 which, as oriented in FIG. 6, exhibits a relatively small effective cross-sectional flow area. Consequently, the opening and closing times are such that the rate of flow limits efficiency. The circular nature of the conventional through bore 2 in combination with the circular seat associated therewith presents a small cross-sectional opening as the valve is opening or closing. The cross-sectional area of the opening associated with such a conventional valve is illustrated in FIG. 12.

Oldham coupling devices have been employed in rotary valve applications in internal combustion engines to provide a rotational interlock between the driving mechanism and the valve body. Such devices allow for axial misalignment between components and, to that end, require some clearance for movement of the components transverse to the rotational axis of the valve. With such clearances and through the use of meshing gears for driving such a system, backlash with the inherent impacts on the components associated therewith can also become a problem in rotary valve mechanisms.

SUMMARY OF THE INVENTION

The present invention is directed to a rotary valve mechanism of the type employing a valve body positioned within an intake or exhaust passage which rotates about an axis transverse to the passage and which has a central bore therein for selectively providing communication through the passage in which the valve body sits. Efficient and reliable operation are achieved by this invention.

In achieving the foregoing, a first aspect of the present invention contemplates side cut portions on the sides of the valve body which, in cooperation with clearance areas in the passage about each valve body, provides for flow throughout a substantial portion of the opening and closing movements of the valve both through the central bore and around the outside of the valve body. In this way, flow area is increased and efficiency is correspondingly increased.

In a second aspect of the present invention, attention is directed to the through bore which assumes a substantially square cross section. The employment of a substantially square through bore in the valve body significantly increases the cross-sectional area of flow during the opening and closing movements of the valve.

In yet a further aspect of the present invention, a biasing means is contemplated at one end of the valve train. The biasing mechanism closes the clearance by biasing the drive train in one direction. In this way, impact between the drive train and the valve components can be minimized or eliminated.

Thus, a rotary valve system is contemplated which provides increased cross-sectional flow area particularly during opening and closing cycles of the valves. Additionally, increased reliability and longevity of such systems are contemplated. Accordingly, it is an object of the present invention to provide an improved rotary valve system for internal combustion engines. Other and further objects and advantages will appear hereinafter.

BRIEF DESCRIPTION OF THE DRAWINGS

FIG. 8 is a detail cross-sectional view of the second embodiment of the present invention.

FIG. 9 is an oblique view of the second embodiment of the present invention.

FIG. 10 is a cross-sectional schematic illustrating movement of a rotary valve in three views.

FIG. 11 is a bottom plan schematic of the second embodiment of the present invention with views corresponding to those illustrated in FIG. 10.

FIG. 15 is a cross-sectional elevation of the drive shaft and valves of the embodiment of FIG. 14.

FIG. 16 is a cross-sectional end view of the drive train of FIG. 15.

FIG. 17 is an exploded oblique view of an oldham mechanism as employed in the embodiment of FIG. 14.

DETAILED DESCRIPTION OF THE PREFERRED EMBODIMENT

Figure 1:
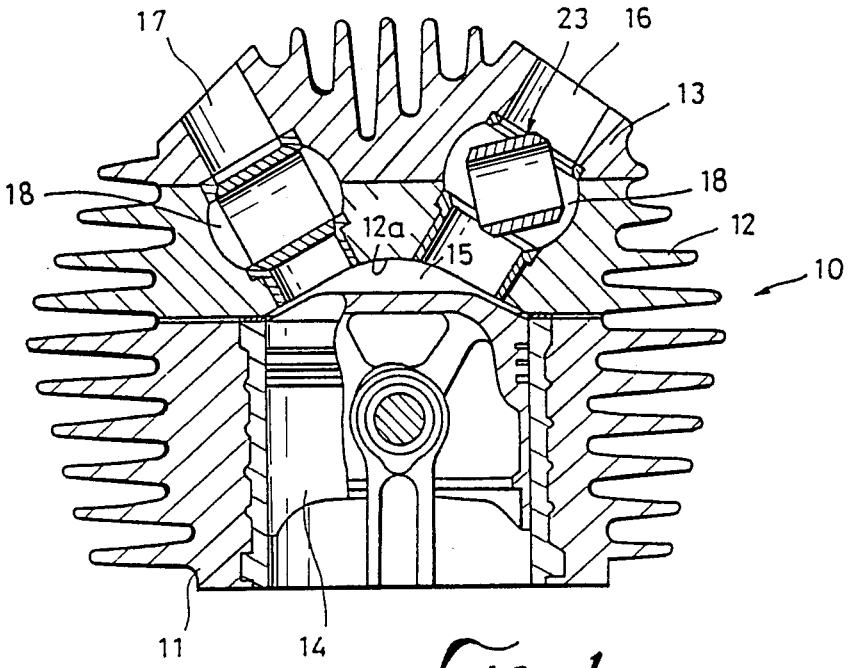
FIG. 1 is a cross-sectional elevation of a first embodiment of the present invention.

Turning in detail to the drawings, FIG. 1 illustrates an internal combustion engine, generally designated 10, including a cylinder block 11 upon which cylinder heads 12 and 13 are affixed. The cylinder heads 12 and 13 are provided with an intake passage 16 and an exhaust passage 17 extending to a combustion chamber 15. The combustion chamber 15 is defined by an upper end surface of a piston 14 and a recess 12*a* of the cylinder head 12. A rotary valve cavity 18 is positioned near the combustion chamber in each of the intake and exhaust passages, 16 and 17, respectively. An outside valve seat 19 and an inside valve seat 20 are provided to either side of each of the rotary valve cavities 18. The valve seats 19 and 20 are shown to be formed of separate inserts 21 and 22 forming rings. The rings define parallel spherical segments of a common internal spherical surface. Thus, the valve seats 19 and 20 are each symmetrical about the centerline of each of the passages. The seats 21 and 22 have surfaces 21*a* and 22*a* of a concave spherical shape to conform to the foregoing internal sphere.

A rotary valve 23 is mounted within each of the rotary valve cavities 18 and is slidably held by the seat members 21 and 22. The rotary valve 23 is provided with a spherical valve body 24 defining an outer spherical surface in which a through bore 25 extends. Side cut portions 26 forming flat surfaces are provided diametrically opposed on the outer surfaces of the valve bodies 24. The surfaces are positioned so as to have a common normal which is perpendicular to both the centerline of the through bore and the axis of rotation of the rotary valve. Looking to FIG. 3, connecting portions 27 are formed on the outer surface of the valve body 24 about the axis of rotation of the valve body which is perpendicular to the through bore 25 and also perpendicular to a common normal of the side cut portions.

The remaining portions 24*a* of the sliding surface of the valve body 24 are spherical. These portions 24*a* surround the openings of the through bore 25 to define spherical segments capable of mating with the valve seats 21 and 22. The spherical portions 24*a* also surround each of the side cut portions such that they may also be placed in mating engagement with the valve seats 21 and 22. The spherical portions 24*a* also surround the connecting portions 27 to act with the engine head for rotational mounting of the valve bodies 24.

Accordingly, the rotary valve mechanisms 23 are adapted to slidably contact with the seat surfaces 21a and 22a of the seat members 21 and 22 by virtue of the sliding surface portions 24a. In this way, the valve body 24 is held by the seat members 21 and 22 to rotate within the rotary valve cavity 18 to provide sealing with at least the valve body oriented such that the through bore may extend transversely to the flow passages 16 or 17.

The rotary valve 23 is connected to a drive shaft 29 of a valve motion mechanism 30 at one of the connecting portions 27. The coupling is made through the employment of an oldham coupling 28. The rotary valves 23 are also mutually connected by an oldham coupling 31.

Figure 3:
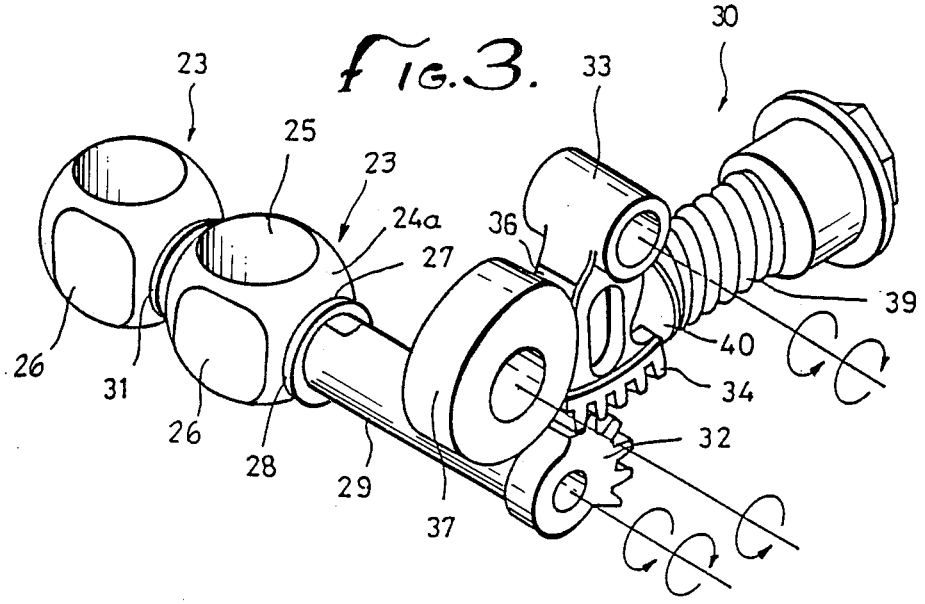
FIG. 3 is an oblique view of the drive train and valve mechanisms of the device of FIG. 1.
Figure 4:
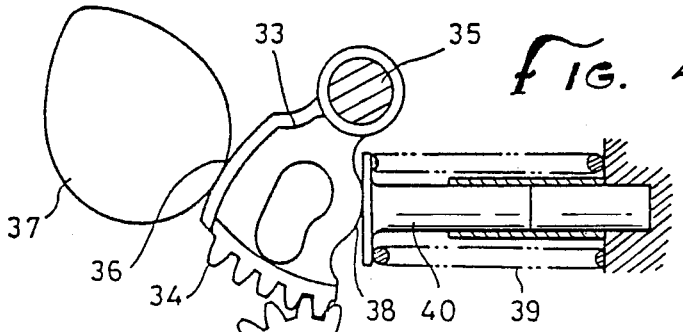
FIG. 4 is an end view of the mechanism of FIG. 3.
Figure 5:
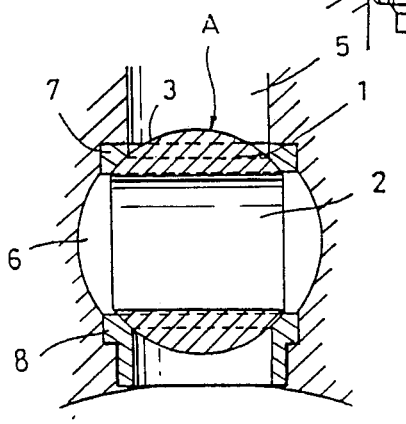
FIG. 5. (PRIOR ART)
FIG. 5 is a detail cross section of a prior art rotary valve.
Figure 6:
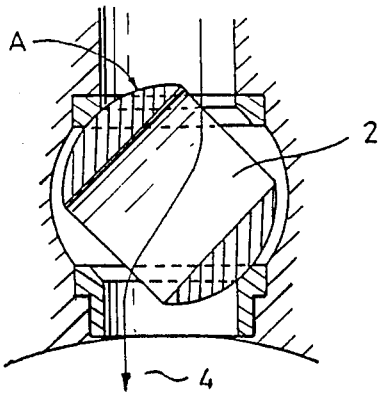
FIG. 6. (PRIOR ART)
FIG. 6 is a detail cross section of the device of FIG. 5.
Figure 7:
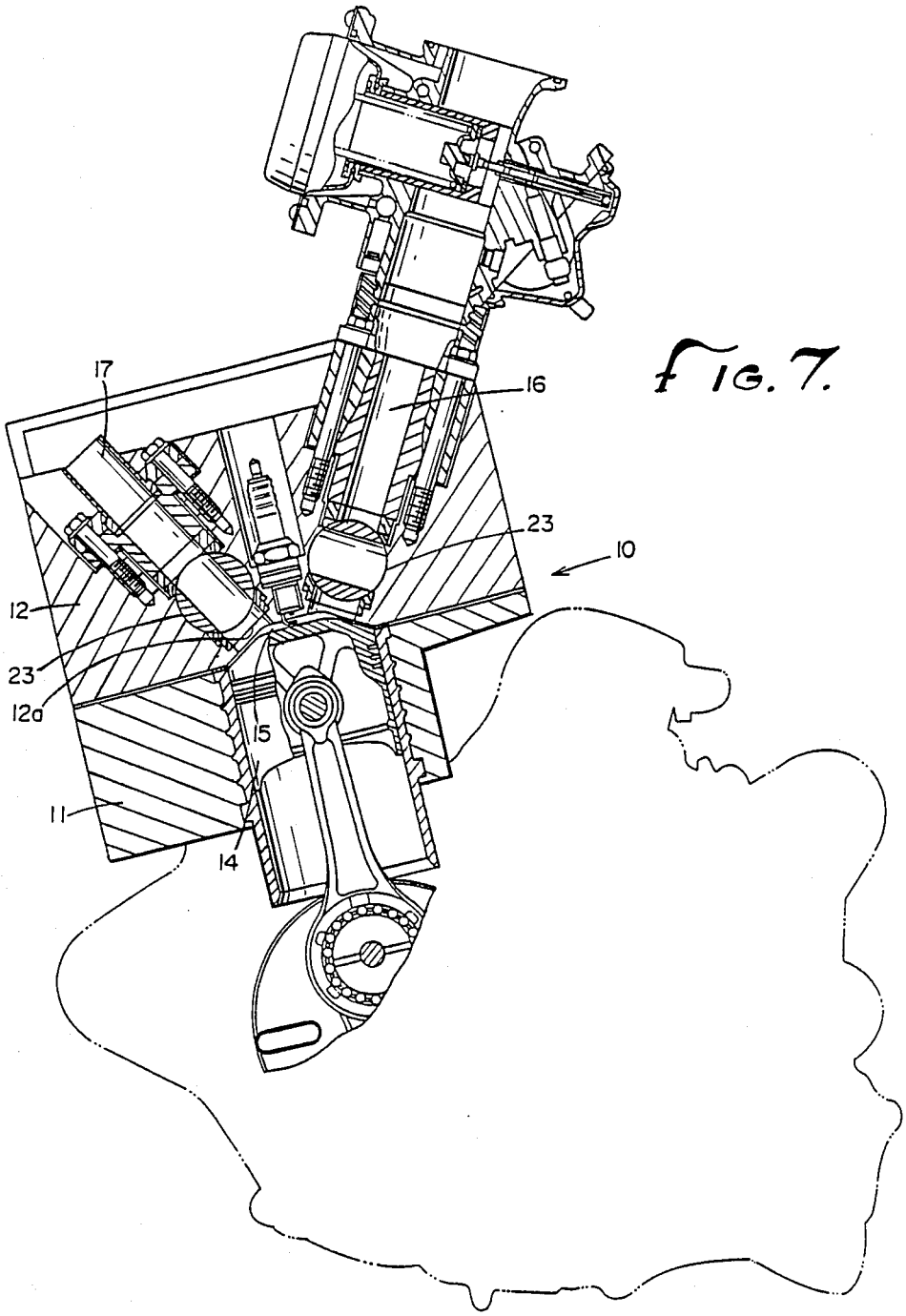
FIG. 7 is a cross-sectional view of a second embodiment of the present invention.

The drive train or valve motion mechanism 30 as shown in FIGS. 3 and 4 is provided with a drive shaft 29 on which a segment gear 32 is fixed. The segment gear 32 is meshed with a segment gear 34 of a rocker arm 33. The rocker arm 33 is caused to rock about a supporting shaft 35 forming a fulcrum. A cam surface 36 of the rocker arm 33 is adapted to engage and follow a cam 37. A second surface 38 on the opposite side of the rocker arm 33 from the cam surface 36 is shown to engage an abutting member 40. The abutting member 40 is biased toward the rocker arm 33 by means of a spring 39. The cam 37 is driven by a chain or gear train from the crankshaft of the associated engine.

In operation, the rotation of the cam 37 causes the rocker arm 33 to engage in a rocking movement. The abutting member 40 returns the rocker 33 such that it follows the cam surface. The segment gear 34 of the rocker arm 33 engages the segment gear 32 such that the latter rocks in a 90 degree segment. By the rocking of the segment gear 32, the rotary valve 23 performs intermittent rocking driven by the drive shaft 29.

When the rotary valve 23 begins to open through the rocking rotation, the bore 25 communicates with the intake passage 16 or exhaust passage 17. The side cut portions 26 are spaced from the clearance areas of the rotary valve cavity 18 so that communication also exists between the surface of the clearance areas and the side cut portions of the rotary valves. As a result, flow areas $S_1$ and $S_2$ open up and are connected by the intermediary space $S_3$ between the clearance area surface 18*a* of the rotary valve cavity 18 and the rotary valve 23.

Figure 2:
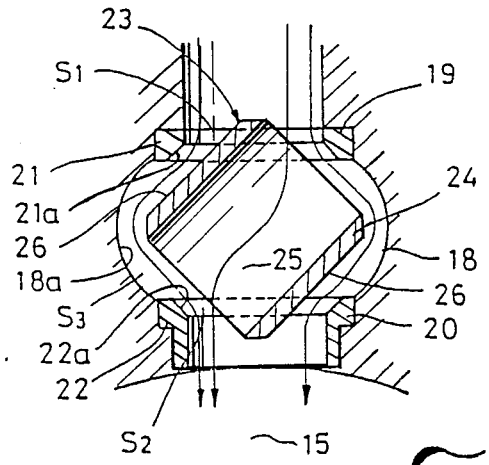
FIG. 2 is a detail cross-sectional elevation of the device of FIG. 1.

Accordingly, air/fuel mixture or exhaust flowing through the passages 16 or 17 pass through the through bore 25 of the rotary valve 23 but also bypass the valve as shown by arrows in FIG. 2. As an alternative to the embodiment of FIG. 1, the space $S_3$ may be formed within the wall surface 18*a* as a groove rather than an expanded space.

Other features may include a Geneva stop mechanism rather than a cam valve motion mechanism.

Figure 12:
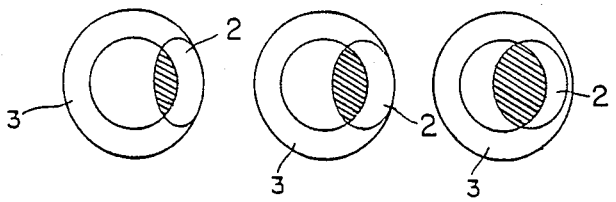
FIG. 12 is a schematic view as in FIG. 11 illustrating a prior art embodiment with views corresponding to the views of FIG. 10.
Figure 13:
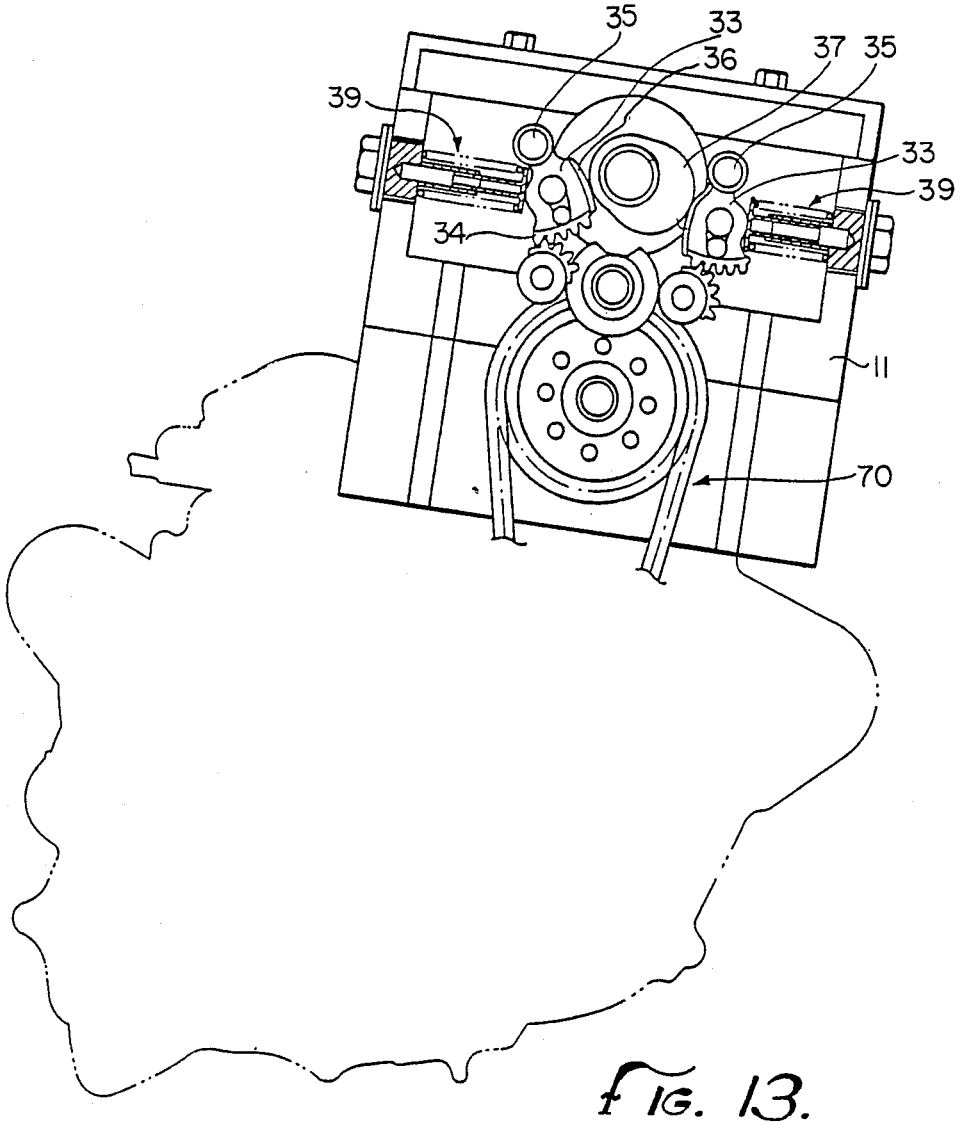
FIG. 13 is a cross-sectional elevation of an engine drive train of the embodiments of the present invention.
Figure 14:
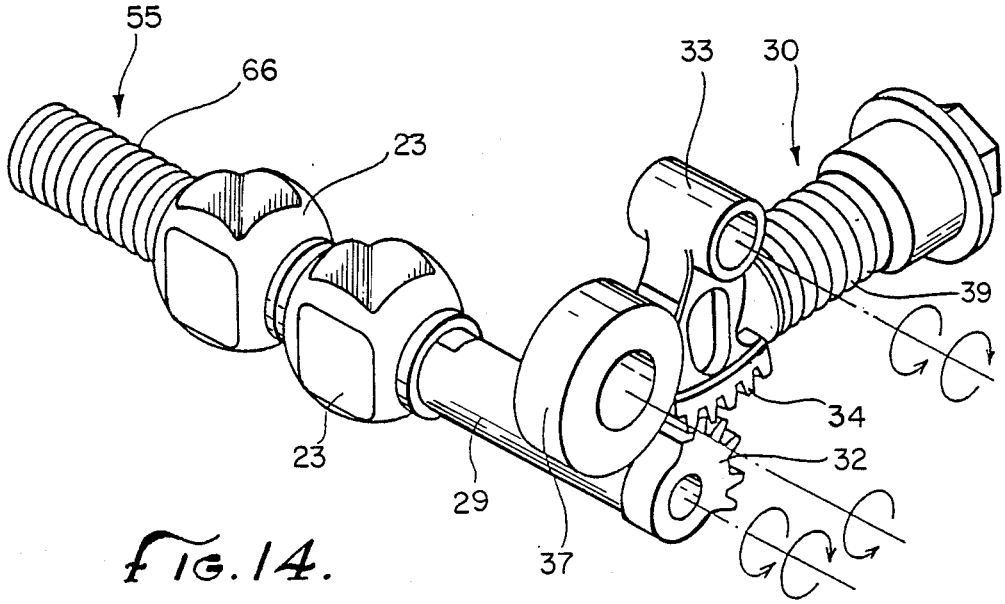
FIG. 14 is an oblique view of the drive mechanism and rotary valves of a third embodiment of the present invention.

Looking then to the embodiment of FIGS. 7 through 11, a valve mechanism is illustrated which incorporates a novel feature in the through bore 25. The through bore 25 has a substantially square cross section. For strength and manufacturing reasons, the substantially square cross-sectional shape is rounded at the corners. FIGS. 10, 11 and 12 illustrate the advantage of a substantially square through bore 25. FIG. 10 illustrates three orientations of the valve 23 relative to the seat 22. FIG. 11 corresponds to the foregoing orientations illustrating in the shaded area 25*a* the amount of opening at those orientations. FIG. 12 illustrates a prior art device having a bore 2, a seat 3 and the shaded portion illustrating the lesser openings as compared with the device of FIG. 11. The square shape may be provided only at the upper opening portion in the case of an intake valve without requiring the square shape throughout the full length of the bore 25. In the case where a rotary valve continues to rotate in a single direction rather than rock, it is advantageous to have the entire through bore exhibit the substantially square cross section.

Turning then to the embodiment of FIGS. 13 through 17, common reference numerals with the prior embodiments illustrate identical or equivalent elements. Better illustrated in this embodiment are the oldham couplings 28 and 31. The oldham coupling 31 is constituted as illustrated in FIG. 17 by inserting joint members 44 and 45 in cross grooves 42 in an intermediate member 43. The joint members 44 and 45 are oriented at 90 degrees from one another to fit within the cross grooves 42. The rotary valves 23 are connected by engaging one of the joint members 44 of the oldham coupling 31 in the engaging groove 27*a* of the connecting portion 27 of the valve 23. The other joint member 45 of the oldham coupling 31 is engaged in the groove 27*a* of the other valve 23.

Another oldham coupling 28 is employed between the drive shaft 29 and the valve 23 most adjacent the drive shaft. The oldham coupling 28 consists of a joint member 44 which is integrally formed with the drive shaft 29. Another joint member 45 is positioned within a groove 27*a* of the valve 23. An intermediate member 43 having cross grooves couples the two joint members together.

A bracket 46 is fixed relative to the cylinder head so as to mount a stop bolt 47. The stop bolt 47 is adapted to abutt against the side surface of the segment gear 32 so as to provide a stop to the movement of the valve mechanism.

On the cylinder head there is provided a receiving portion 56 for accommodating a bias means for biasing the valve mechanism. The biasing means includes a spring mechanism 55 arranged at the end of a receiving portion 54 for the rotary valve mechanism 23. The spring mechanism 55 is provided with a shaft body 57 at one end of which is a large diameter portion 58. A flange 59 and a joint portion 60 are formed to cooperate with an engaging groove 61. Joint portion 60 is inserted into a cross groove 63 of an intermediate connecting member 62. A joint member 64 is slidably inserted into a groove 27*a* at one end of the outermost valve 23. The other end of the shaft body 57 is inserted into a bearing 65 provided in an end wall of the receiving portion 56.

A torsion spring 66 of the spring mechanism 55 includes ends 66*a* and 66*b*. The end 66*b* engages the groove 67 to retain that end fixed relative to the cylinder head. The end 66a engages the groove 61 of the shaft body 57 so as to require rotation with the valve 23.

The employment of the bias spring mechanism 55 is located at one end of the drive mechanism associated with the valves 23. The mechanism thus biases the valve mechanism to eliminate clearances. Consequently, when the drive shaft is actuated, there is no clearance across which the components must move to impact against the valves. Consequently, reliability and longevity of the overall system is improved.

Thus, rotary valve mechanisms for internal combustion engines have been illustrated which improve efficiency, reliability and longevity. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A valve device for an internal combustion engine having intake and exhaust passages, comprising an outside seat and an inside seat in at least one of the passages, said seats defining common internal spherical surface portions;

means forming clearance areas in the passage between said seats, said clearance areas extending laterally from the axis of said passage to an extent greater than that of said seats;

a rotary valve disposed on a rotary axis between said seats having a sliding surface defining common external spherical surface portions capable of mating with said common internal spherical surface portions, a through bore and side cut portions from said sliding surface facing said clearance areas to allow flow about said rotary valve when said spherical portions are not in mating relationship;

a drive shaft aligned along the common rotary axis to one side of said rotary valves; and a torque bias means for biasing said rotary valve in a first rotational direction, said means being to the other side of said rotary valve from said drive shaft along the rotary axis.

2. A valve device for an internal combustion engine having intake and exhaust passages, comprising an outside seat and an inside seat in at least one of the passages, said seats defining common internal spherical surface portions;

means forming clearance areas in the passage between said seats, said clearance areas extending laterally from the axis of said passage to an extent greater than that of said seats;

a rotary valve disposed on a rotary axis between said seats having a sliding surface defining common external spherical surface portions capable of mating with said common internal spherical surface portions, a substantially square through bore and side cut portions from said sliding surface facing said clearance areas to allow flow about said rotary valve when said spherical portions are not in mating relationship;

a drive shaft aligned along the common rotary axis to one side of said rotary valves; and a torque bias means for biasing said rotary valve in a first rotational direction, said means being to the other side of said rotary valve from said drive shaft along the rotary axis.

3. For an internal combustion engine having a cylinder, an intake gas flow passage and an exhaust gas flow passage communicating therewith, a rotary valve device for disposition in either one of said gas flow passages for controlling the flow of gas therethrough, said rotary valve device comprising:

wall means in said flow passage defining a valve cavity intermediate the length thereof having oppositely spaced, substantially coaxially aligned passage openings defined therein;

oppositely facing annular seats about said passage openings;

a valve body mounted for angular movement in said valve cavity, said valve body being movable into and out of engagement with said valve seats whereby, in engagement with said valve seats, said valve body prevents the flow of gas between said passage openings and out of engagement with said valve seats, the gas flows around said valve body between said passage openings; and drive means for imparting pivotal movement to said valve body about an axis substantially normal to said passage axis.

4. The valve device of claim 3 wherein said seats are separate insert members.

5. The valve device of claim 3 in which said drive means comprises a drive shaft aligned with the axis of movement of said valve body to one side thereof, connecting members between said drive shaft and said valve body, said connecting members being slidable transversely and fixed rotationally relative to said valve body and a torque bias means for biasing said valve body in a first rotational direction, said biasing means being disposed on said axis of movement on the other side of said valve body from said drive shaft.

6. The valve device of claim 3 wherein said annular seats and said first valve body surface portion are formed as complementary spherical surfaces.

7. The valve device of claim 3 wherein said valve body includes oppositely spaced flat surfaces having a common normal perpendicular to said valve body pivot axis.

8. For an internal combustion engine having a cylinder, an intake gas flow passage and an exhaust gas flow passage communicating therewith, a rotary valve device for disposition in either one of said gas flow passages for controlling the flow of gas therethrough, said rotary valve device comprising:

wall means in said flow passage defining a valve cavity intermediate the length thereof having oppositely spaced, substantially coaxially aligned passage openings defined therein;

oppositely facing annular seats about said passage openings;

a valve body including a through-bore adapted for gas flow between said oppositely spaced passage openings when said valve body is moved out of said one position mounted for angular movement in said valve cavity, said valve body having a first surface portion capable of sealingly engaging said seats with said valve body in one angular position in said valve cavity, and a second surface portion cooperable with the wall of said cavity to allow gas flow between said passage openings when said valve body is moved out of said one position; and drive means for imparting pivotal movement to said valve body about an axis substantially normal to said passage axis.

9. The valve device of claim 8 wherein said second surface portion comprises flat surfaces parallel to the axis of said through bore.

10. The valve device of claim 8 wherein said through bore is substantially circular in cross section.

11. The valve device of claim 8 wherein said through bore is substantially rectangular in cross section.

12. The valve device of claim 8 wherein said first valve body surface portion includes two parallel spherical segments.

13. The valve device of claim 12 wherein said spherical segments are symmetrically disposed about an axis normal to the axis of movement of said valve body.

14. The valve device of claim 12 wherein said spherical segments are displaced from and parallel to the axis of movement of said valve body.

15. The valve device of claim 8 wherein said first and said second surface portions are substantially spherically formed and said second surface portion cooperates with said cavity wall to define a clearance space to conduct gas flow between said passage openings about the exterior of said valve body when said valve body is moved angularly out of said one position.

16. The valve device of claim 15 wherein said clearance space between said cavity wall and said second surface is defined by a groove in said cavity wall.

17. The valve device of claim 15 wherein said internal spherical surface portions include two parallel spherical segments.

18. The valve device of claim 17 wherein said spherical segments are symmetrically disposed about the centerline of the passage.

19. The valve device of claim 18 wherein said spherical segments are displaced from and parallel to said axis of movement of said valve body.

* * * * *